US011713886B2

(12) United States Patent
Bierbaum et al.

(10) Patent No.: US 11,713,886 B2
(45) Date of Patent: Aug. 1, 2023

(54) COOKING GRATE FOR A GAS BURNER COOKTOP

(71) Applicant: Haier US Appliance Solutions, Inc., Wilmington, DE (US)

(72) Inventors: Charles Andrew Bierbaum, Louisville, KY (US); Logan Chayse Dunaway, Greenville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 106 days.

(21) Appl. No.: 17/226,533

(22) Filed: Apr. 9, 2021

(65) Prior Publication Data

US 2022/0325899 A1 Oct. 13, 2022

(51) Int. Cl.

| | |
|---|---|
| ***F24C 15/10*** | (2006.01) |
| ***F24C 15/00*** | (2006.01) |
| ***F24C 3/02*** | (2021.01) |

(52) U.S. Cl.

CPC ..... *F24C 15/107* (2013.01); *F24C 3/027* (2013.01); *F24C 15/006* (2013.01)

(58) Field of Classification Search

CPC ..... F24C 3/006; F24C 3/027; F24C 15/107
USPC ..... 126/39 B, 39 R, 39 E, 39 C
See application file for complete search history.

(56) References Cited

U.S. PATENT DOCUMENTS

| | | | | |
|---|---|---|---|---|
| 4,236,503 | A | 12/1980 | Kemp | |
| 10,309,657 | B2 | 6/2019 | Trice | |
| 10,495,320 | B2 | 12/2019 | Bierbaum | |
| 2018/0003389 | A1* | 1/2018 | Trice | F24C 3/027 |

FOREIGN PATENT DOCUMENTS

| | | | |
|---|---|---|---|
| CN | 207762973 | U | 8/2018 |
| CN | 209246172 | U | 8/2019 |
| CN | 111351071 | A | 6/2020 |

* cited by examiner

*Primary Examiner* — Vivek K Shirsat
(74) *Attorney, Agent, or Firm* — Dority & Manning, P.A.

(57) ABSTRACT

A cooking grate includes a peripheral frame defining a periphery of the cooking grate, a plurality of fingers extending from the peripheral frame toward a center of the cooking grate, and a slot formed in the peripheral frame, the slot forming a passageway through the peripheral frame from a lower portion to an upper portion thereof in the vertical direction.

19 Claims, 3 Drawing Sheets

COOKING GRATE FOR A GAS BURNER COOKTOP

FIELD OF THE INVENTION

The present subject matter relates generally to cooktop appliances, and more particularly to cooking grates for gas burner cooktop appliances.

BACKGROUND OF THE INVENTION

Conventional cooktop range appliances can incorporate either gas powered or electric powered cooktops (or burners), or a combination of gas and electric burners. For gas powered burners, a flame is produced and supplied with gas to emit heat above the gas burner (e.g., to a cooking utensil such as a pot or pan). A cooking grate is typically provided over the gas burner, on which the cooking utensil may rest to receive the heat from the flame. Many cooking grates have a lattice structure design, for instance, a base frame with bars providing ample open area through which the heat is transferred to the cooking utensil.

Recently, aesthetic improvements have become common in requests from consumers of appliances such as cooktop appliances. For instance, a desire for monochromatic color designs have increased (e.g., for side panels, trim, etc.). However, conventional designs and materials used are susceptible to color warping from heat generated around the gas burner. For instance, heat from the gas burner may be emitted out a lateral side of the cooking grate and damage certain aesthetic components attached to the side of the cooktop.

Accordingly, a cooking grate that obviates one or more of the above-mentioned drawbacks would be beneficial. Particularly, a cooking grate that is capable of reducing an amount of heat directed to a lateral side of a cooktop would be advantageous.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking grate is provided. The cooking grate may define a vertical direction, a lateral direction, and a transverse direction. The cooking grate may include a peripheral frame rail defining a passageway extending from an inlet to an outlet, the outlet being positioned above the inlet along the vertical direction; and a utensil support structure extending inward from the peripheral frame rail for supporting a cooking utensil.

In another exemplary aspect of the present disclosure, a cooking appliance is disclosed. The cooking appliance may define a vertical direction, a lateral direction, and a transverse direction. The cooking appliance may include a cooktop including a gas burner and a cooking grate mountable over the gas burner. The cooking grate may include a peripheral frame rail defining a passageway extending from an inlet to an outlet, the outlet being positioned above the inlet along the vertical direction; and a utensil support structure extending inward from the peripheral frame rail for supporting a cooking utensil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
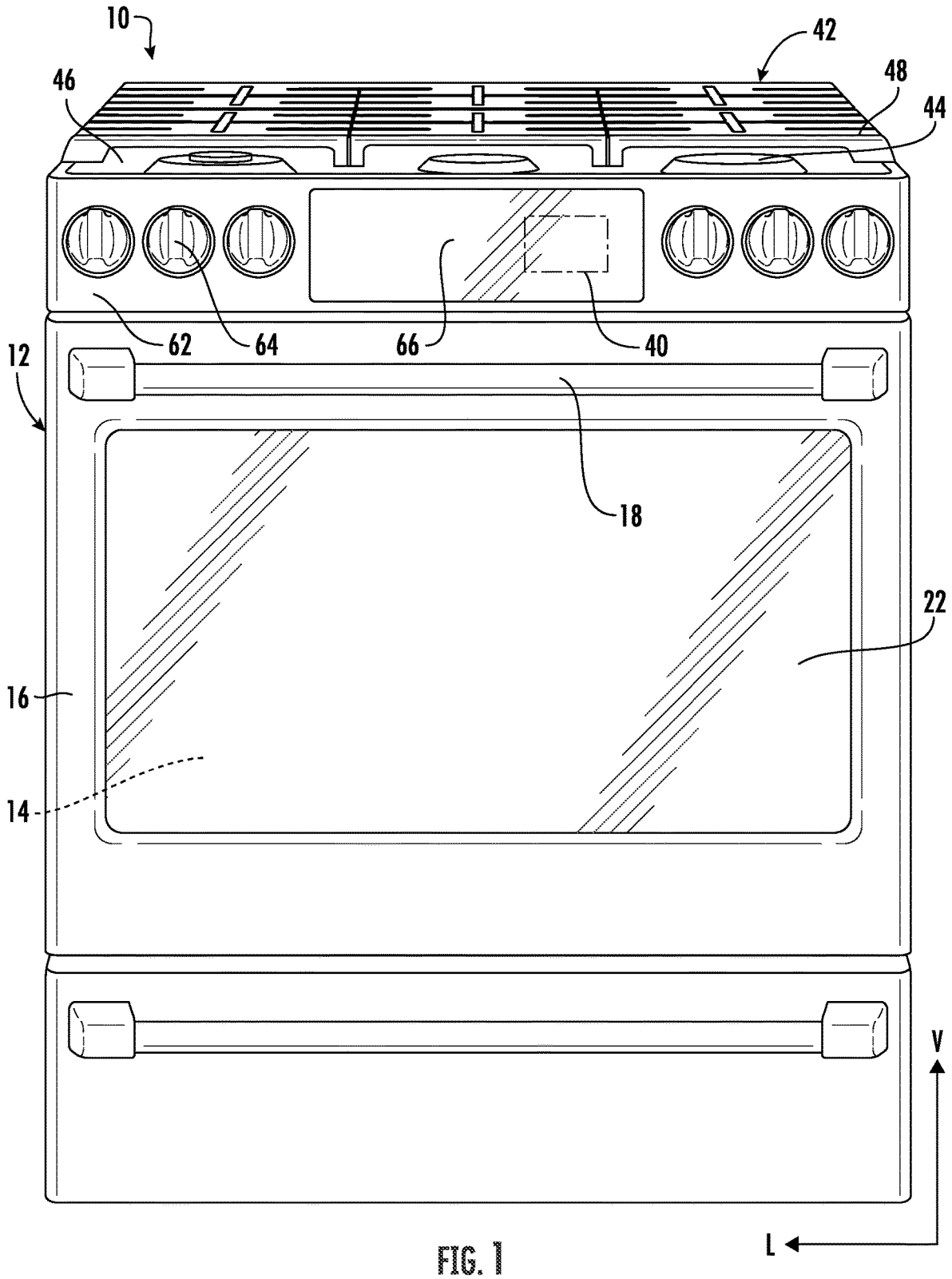
FIG. 1 provides a front perspective view of an oven-range cooktop appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a perspective view of a cooking appliance, such as a cooktop appliance 10, according to exemplary embodiments of the present disclosure. Generally, cooktop appliance 10 defines a vertical direction V, a lateral direction L, and a transverse direction T. The vertical direction V, lateral direction L, and transverse direction T are mutually perpendicular and form an orthogonal direction system. As will be understood, cooktop appliance 10 is provided by way of example only, and the present subject matter may be used in any suitable appliance. Thus, the present disclosure may be used with other oven, range, or cooktop appliance configurations (e.g., configurations that define multiple interior cavities for the receipt of food, include no interior cavities, or are otherwise different than the configuration shown in FIG. 1), as well as other suitable appliances, as would be understood in light of the present disclosure.

Cooktop appliance 10 includes an insulated cabinet 12 with an interior cooking chamber 14 defined by an interior surface of cabinet 12. Cooking chamber 14 is configured for the receipt of one or more food items to be cooked. Cooktop appliance 10 includes a door 16 rotatably mounted to cabinet 12 (e.g., with a hinge— not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As would be understood, one or more internal heating elements (e.g., baking or broiling heating elements) may be provided within cooking chamber 14 to cook or otherwise heat items therein.

Cooktop appliance 10 can include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, a baking rack (not pictured) is positioned in cooking chamber 14 for the receipt of food items or utensils containing food items.

Cooktop appliance 10 may include a cooktop surface 42 having one or more heating elements 44 for use in heating or cooking operations. In exemplary embodiments, cooktop surface 42 is comprised of a metal (e.g., steel) panel 46 on which one or more grates 48, described in further detail below, may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of cooktop appliance 10 include a controller 40 (e.g., configured to control one or more operations of cooktop appliance 10). For example, controller 40 may control at least one operation of cooktop appliance 10 that includes an internal heating element or cooktop heating element 44. Controller 40 may be in communication (via for example a suitable wired or wireless connection) with one or more of heating element(s) 44 and other suitable components of cooktop appliance 10, as discussed herein. In general, controller 40 may be operable to configure cooktop appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout cooktop appliance 10. As illustrated, controller 40 may be located within a user interface 62 of cooktop appliance 10. In some such embodiments, input/output ("I/O") signals may be routed between controller 40 and various operational components of cooktop appliance 10, such as heating element(s) 44, control knobs 64, display component 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of cooktop appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include a display component 66, such as a digital or analog display configured to provide operational feedback to a user.

Figure 2:
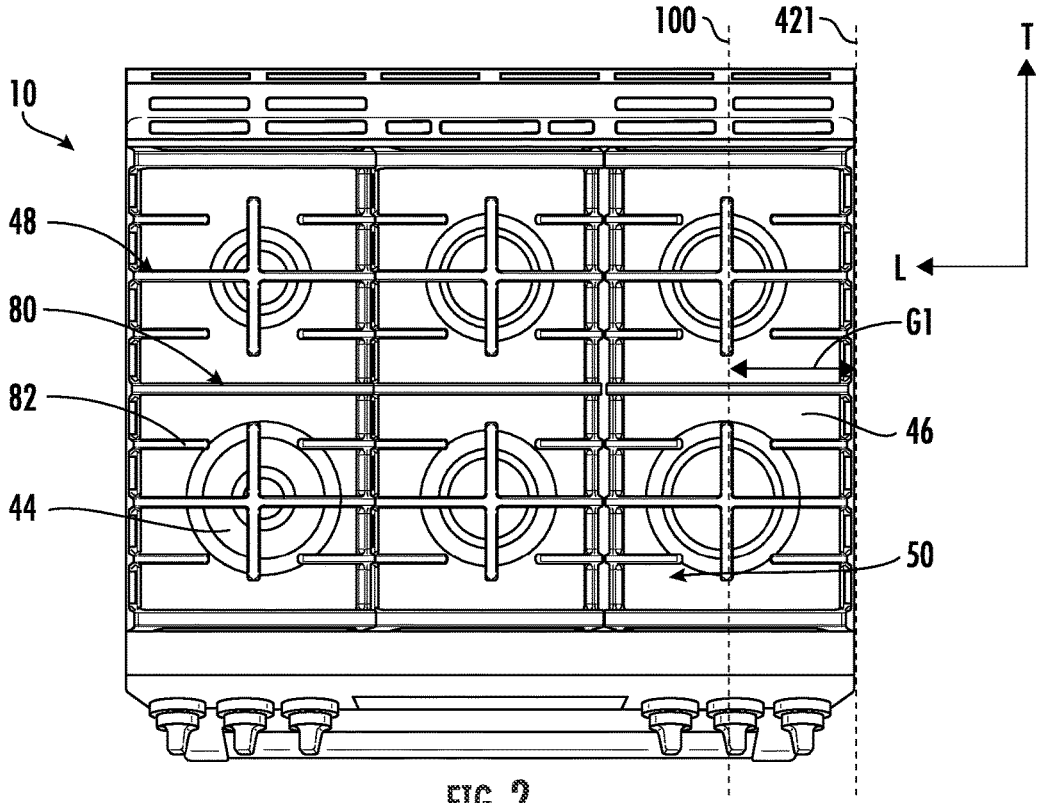
FIG. 2 provides a top view of the exemplary cooktop appliance of FIG. 1.

FIG. 2 provides a top view of the cooktop appliance of FIG. 1. As described above, cooktop surface 42 may include a plurality of heating elements 44 and a panel 46. Panel 46 may be concave (e.g., downward along the vertical direction V) to form a depression or cavity 50 therein. Thus, heating elements 44 may be provided within the cavity 50, and cooking grates 48 may be positioned over top of the heating elements 44 (e.g., along the vertical direction V). In this example, cooktop surface 42 includes six heating elements 44. It should be noted that the disclosure is not limited to this, and cooktop surface 42 may include fewer or more heating elements 44 as specific applications dictate. In some embodiments, one or more heating elements 44 may be located proximate an edge of panel 46, as will be described in more detail below.

Cooktop surface 42 may include one or more cooking grates 48 provided over the heating elements 44. As shown in FIG. 2, for example, cooktop surface 42 may include three cooking grates 48. It should be noted that the disclosure is not limited to this, and cooktop surface 42 may include fewer or more cooking grates 48 as specific applications dictate. Each cooking grate 48 may extend from a rear of panel 46 to a front of panel 46 along the transverse direction. Additionally or alternatively, cooking grates 48 may be positioned adjacent to each other along the lateral direction L.

Figure 3:
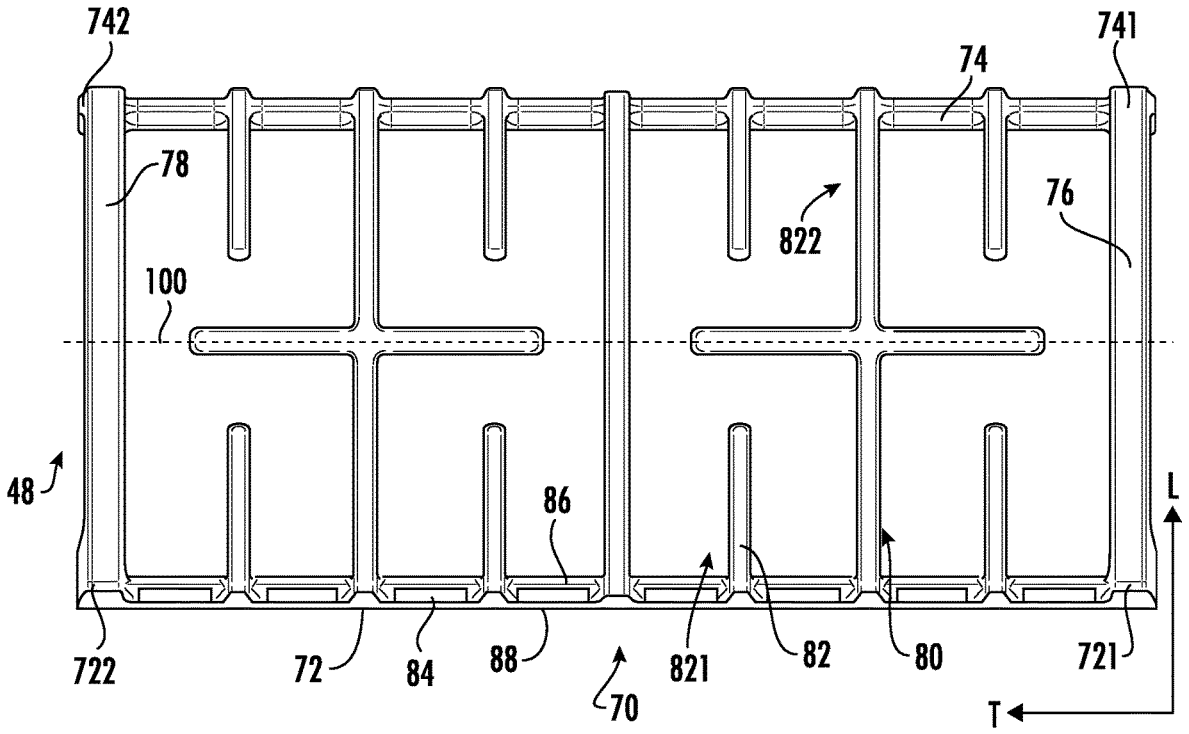
FIG. 3 provides a top view of an exemplary cooking grate of the cooktop appliance of FIG. 1.
Figure 5:
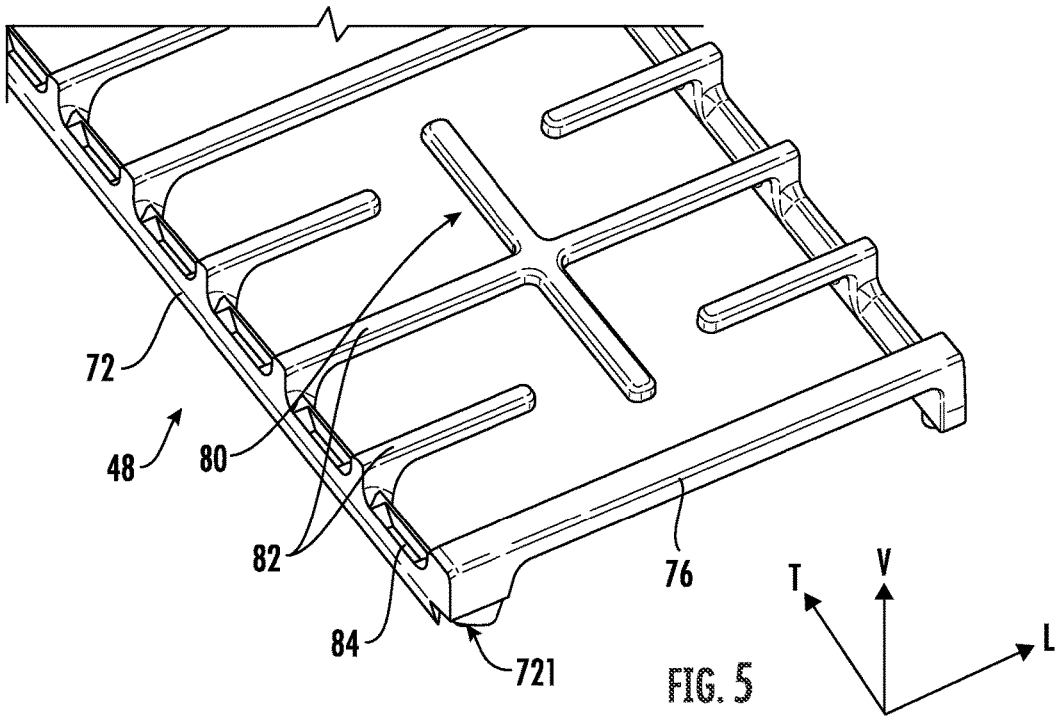
FIG. 5 provides a perspective view of the exemplary cooking grate of FIG. 3.

FIG. 3 provides a top view of an exemplary cooking grate 48. Cooking grate 48 may include a peripheral frame rail 70. Peripheral frame rail 70 may define a periphery of cooking grate 48. For example, the periphery may refer to a perimeter edge of cooking grate 48 (e.g., surrounding one or more heating elements 44). In one embodiment, peripheral frame rail defines an outer border of cooking grate 48. Peripheral frame rail 70 may have any suitable shape. For instance, as shown in FIGS. 2, 3, and 5, peripheral frame rail 70 may be a rectangle. However, peripheral frame rail 70 may be circular, semi-circular, oval, square, or any other suitable shape depending on specific applications.

In some embodiments, peripheral frame 70 includes a first side rail 72 and a second side rail 74 opposite first side rail 72. First side rail 72 and second side rail 74 may be parallel to each other (e.g., along the transverse direction T). First side rail 72 and second side rail 74 may be connected to each other via a first cross strut 76 and a second cross strut 78. First cross strut 76 may connect a first transverse end 721 of first side rail 72 with a first transverse end 741 of second side rail 74. Each of the first transverse ends 721 and 741 may be located proximal a front of cooktop surface 42 (e.g., in the transverse direction). Second cross strut 78 may connect a second transverse end 722 of first side rail 72 with a second transverse end 742 of second side rail 74. Each of the second transverse ends 722 and 742 may be located proximal a rear of cooktop surface 42. However, these orientations are by way of example only.

Cooking grate 48 may include a utensil support structure 80 for supporting a cooking utensil over one or more of heating elements 44. Utensil support structure 80 may include a series of support fingers 82. For instance, a first set 821 of the plurality of support fingers 82 may extend inward from first side rail 72 and a second set 822 of the plurality of support fingers 82 may extend inward from second side rail 74 (e.g., with respect to peripheral frame rail 70). In detail, as best shown in FIG. 3, each of the plurality of support fingers 82 may extend toward a center line 100 extending in the transverse direction T that bisects cooking grate 48 laterally. In some embodiments, each of the plurality of support fingers 82 are parallel to each other. In other embodiments, some of the plurality of support fingers 82 connect first side rail 72 to second side rail 74. In still other embodiments, some of the plurality of support fingers 82 extend in a transverse direction (e.g., parallel to first and second side rails 72 and 74). In still other embodiments, some of the plurality of support fingers 82 extend from the first and second side rails 72 and 74 at an acute angle (e.g., between 30° and 60°). Accordingly, the plurality of support fingers 82 may allow a cooking utensil (e.g., cooking pot, frying pan, etc.) to be supported above one or more heating elements 44 (e.g., gas heating elements) such that heat and heated air may pass between the plurality of fingers 82 to provide heat to the cooking utensil. The plurality of support fingers 82 may thus be spaced apart along first side rail 72 and second side rail 74 in the transverse direction T (e.g., as shown in FIG. 3).

The peripheral frame rail 70 may define a passageway 84. In detail, a plurality of passageways 84 may be formed in peripheral frame rail 70. For instance, first side rail 72 may have one or more passageways 84 defined therein. The one or more passageways 84 may be formed between proximal ends of adjacent support fingers 82. For example, with reference to FIG. 3, in the transverse direction T, a first passageway 84 may be defined between first cross strut 76 and a first support finger 82, and a second passageway 84 may be defined between the first support finger 82 and a second adjacent support finger 82. This pattern may continue in the transverse direction T along first side rail 72. Additionally or alternatively, more than one passageway 84 may be defined between adjacent support fingers 82. Additionally or alternatively, passageways 84 may be formed in first rail 72, second rail 74, or both first rail 72 and second rail 74.

Figure 4:
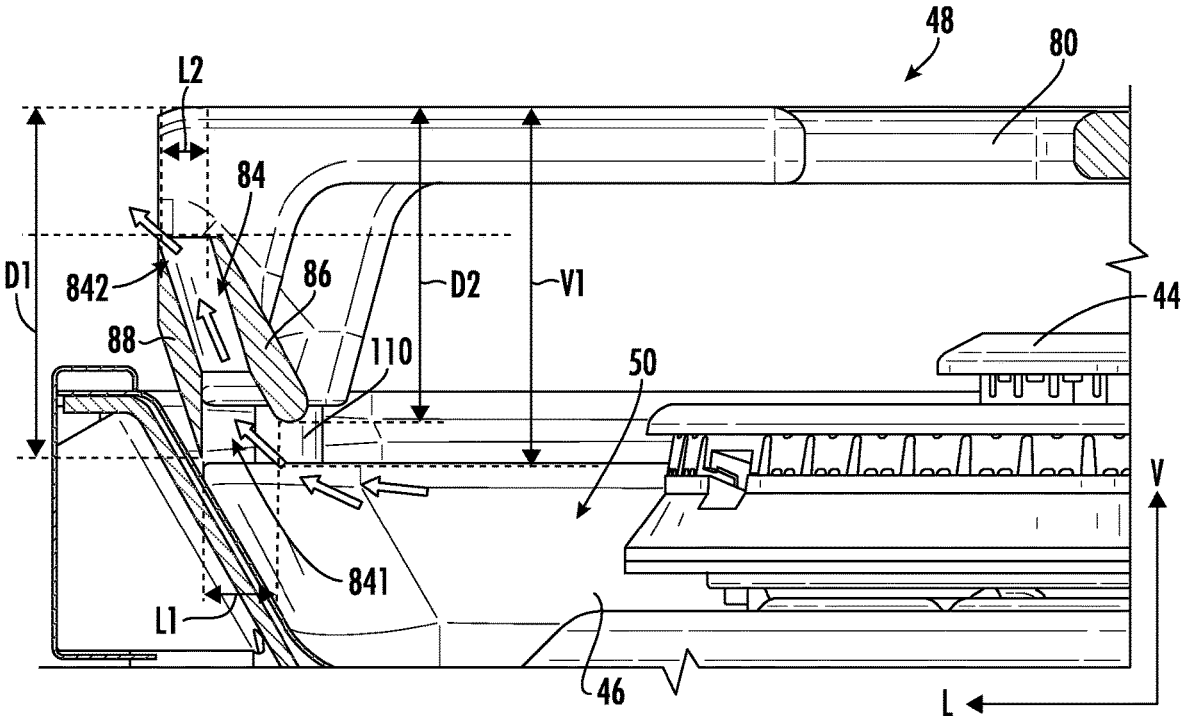
FIG. 4 provides a front cut-away cross-section view of the exemplary cooking grate of FIG. 3, showing a slot.

In some embodiments, passageway 84 defines a rectangular cross-section in the lateral direction L and the transverse direction T. However, passageway 84 may have any suitable cross section, such as square, circular, elliptical, etc., depending on specific applications. In detail, first side rail 72 may include a first lateral side wall 86 and a second lateral side wall 88. As best shown in FIG. 4, passageway 84 may be defined between first lateral sidewall 86 and second lateral sidewall 88. First lateral side wall 86 and second lateral sidewall 88 may each extend along the transverse direction T. First lateral sidewall 86 may be positioned laterally inward (e.g., proximal heating element 44) from second lateral sidewall 88. In some embodiments, first lateral side wall 86 and second lateral side wall 88 are provided at an acute angle with respect to the vertical direction V. Thus, heated air generated from heating element 44 may be more easily exhausted via passageway 84.

An inlet 841 of passageway 84 may be defined at a lower portion of first side rail 72 in the vertical direction. In detail, as best shown in FIG. 4, inlet 841 may be defined along a bottom of first side rail 72. However, inlet 841 may be partially defined in the lateral direction L as well as the vertical direction V. For example, a distal bottom edge of second lateral side wall 88 may be positioned lower than a distal bottom edge of first lateral side wall 86. In other words, a distance D1 between the distal bottom edge of second lateral wall 88 and a top of cooking grate 48 is greater than a distance D2 between the distal bottom edge of first lateral wall 86 and the top of cooking grate 48. Accordingly, inlet 841 may be defined in the vertical direction V and the lateral direction L. As would be understood, inlet 841 may additionally or alternatively formed either entirely in the vertical direction V or entirely in the lateral direction L according to specific embodiments.

An outlet 842 of passageway 84 may be defined at an upper portion of first side rail 72 in the vertical direction V. In detail, outlet 842 may be defined along a top of first side rail 72. However, similar to inlet 841, outlet 842 may be partially defined in the lateral direction as well as the vertical direction V. Accordingly, outlet 842 of passageway 84 may be provided above inlet 841 of passageway 84 along the vertical direction V. As mentioned above, each of first lateral side wall 86 and second lateral side wall 88 may be orientated at an acute angle with respect to the vertical direction V. Thus, in some embodiments, passageway 84 is orientated at an acute angle with respect to the vertical direction V. In detail, inlet 841 may be positioned laterally inward (e.g., toward heating element 44) from outlet 842. Advantageously, the heated air from heating element 44 may naturally flow into inlet 841 and out of outlet 842 due to thermodynamic principles.

A lateral distance L1 between the first lateral side wall 86 and the second lateral side wall 88 at inlet 841 may be greater than a lateral distance L2 between the first lateral side wall 86 and the second lateral side wall 88 at outlet 842. In detail, a cross-section of passageway 84 in a horizontal plane (e.g., defined in the lateral direction L and the transverse direction T) may decrease from inlet 841 to outlet 842. Accordingly, a nozzle shape may be formed within passageway 84. Advantageously, the heated air from heating element 44 may be propelled through passageway 84 according to natural thermodynamic and fluid dynamic principles (e.g., via a venturi effect). Additionally or alternatively, as first lateral side wall 86 and second lateral side wall 88 retain heat and increase in temperature, a pressure difference between inlet 841 and outlet 842 of passageway 84 may induce airflow through passageway 84 and more efficiently release heated air via passageway 84. Thus, the heated air may be restricted from passing along an outside of second lateral side wall 88 (e.g., between second lateral side wall 88 and a side of panel 46. For instance, as mentioned above (and shown most clearly in FIG. 4), panel 46 may be concave downward in the vertical direction V to form plate cavity 50. By inducing the heated air to flow through passageway 84 instead of between second lateral side wall 88 and panel 46, a side of oven appliance 10 (e.g., decorative trim, side panels, etc.) may be subjected to lower temperatures during operation of cooktop surface 42, thus allowing a wider range of materials and designs to be implemented.

Additionally or alternatively, by inducing the heated air to flow through passageway 84 and subsequently reducing a temperature experienced by the side of oven appliance 10, one or more heating elements 44 may be positioned close to a lateral edge of cooktop surface 42. For instance, referring to FIG. 2, a first heating element 44 and a second heating element 44 (e.g., a front heating element and a rear heating element) may be positioned such that a distance G1 between center line 100 and lateral edge 421 of cooktop surface 42 is about 5 inches to about 6 inches. In some embodiments, distance G1 is about 5.5 inches. Advantageously, more heating elements 44 may be included in cooktop surface 42, improving performance abilities and increasing a range of implementations of heating elements 44.

In some embodiments, center line 100 is positioned over a center of the front heating element 44 and the rear heating element 44. In detail, a center of the front heating element 44 and a center of the rear heating element 44 may be colinear with center line 100. Accordingly, the distance from center line 100 of cooking grate 48 to the lateral edge 421 of cooktop surface 42 may be about 5 inches to about 8 inches. In some embodiments, the distance is about 5.5 inches (i.e., equal to distance G1).

Cooking grate 48 may include a support peg 110. In detail, a plurality of support pegs 110 may be connected to cooking grate 48. For instance, a first support peg 110 may be positioned at the junction of first cross strut 76 and first side rail 72, a second support peg 110 may be positioned at the junction of first cross strut 76 and second side rail 74, a third support peg 110 may be positioned at the junction of second cross strut 78 and first side rail 72, and a fourth support peg 110 may be positioned at the junction of second cross strut 78 and second side rail 74. The plurality of support pegs 110 may support cooking grate 48 (e.g., utensil support structure 80) over top of heating elements 44. For instance, one or more tabs may extend toward an interior of panel 46, on which support pegs 110 may rest. The one or more tabs may be provided below a top surface of the panel 46 along the vertical direction V (e.g., within cavity 50). Accordingly, a resting position of the support peg 110 on the cooktop appliance may be located below a top surface of the cooktop surface 42 in the vertical direction V. However, in some embodiments, a resting position of the support peg 110 may be located at the top surface of the cooktop surface 42. For instance, cooktop surface 42 may be a flat surface, and support peg 110 may rest upon the flat surface of cooktop surface 42 (e.g., without being countersunk within a convex formed in cooktop surface 42).

A distance V1 from a bottom of support peg 110 to the top of cooking grate 48 (e.g., utensil support structure 80) may be greater than distance D2 from the bottom of second lateral side wall 88 to the top of cooking grate 48. Accordingly, in one exemplary embodiment, first side rail 72 and second side rail 74 do not extend into plate cavity 50 deeper than the bottom of support peg 110. Advantageously, this may reduce the amount of material used in forming cooking grate 48 by eliminating the need for an additional heat shield to be added to a bottom of second lateral side wall 88.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking grate defining a vertical direction, a lateral direction, and a transverse direction, the cooking grate comprising:

a peripheral frame rail defining a passageway extending from an inlet to an outlet, the outlet being positioned above the inlet along the vertical direction, wherein the peripheral frame comprises:

a first side rail extending in the transverse direction, the first side rail comprising a first lateral side wall and a second lateral side wall provided outward from the first lateral side wall along the lateral direction, the passageway being defined between the first and second lateral side walls, and wherein a distal bottom edge of the second lateral side wall is positioned lower than a distal bottom edge of the first lateral side wall along the vertical direction; and a utensil support structure extending inward from the peripheral frame rail for supporting a cooking utensil.

2. The cooking grate of claim 1, wherein the peripheral frame rail further comprises a second side rail extending in the transverse direction parallel to and opposite the first side rail along the lateral direction.

3. The cooking grate of claim 2, wherein the passageway defines a rectangular cross-section in the lateral and transverse directions.

4. The cooking grate of claim 2, wherein a lateral distance between the first lateral side wall and the second lateral side wall at the inlet of the passageway is greater than a lateral distance between the first lateral side wall and the second lateral side wall at the outlet of the passageway.

5. The cooking grate of claim 2, further comprising:

a cross strut connecting a first transverse end of the first side rail to a first transverse end of the second side rail; and a support peg positioned at a junction of the cross strut and the first transverse end of the first side rail, wherein the support peg extends downward in the vertical direction.

6. The cooking grate of claim 5, wherein a distance from a bottom of the support peg to a top of the passageway is greater than a distance from a bottom of the first lateral side wall to the top of the passageway.

7. The cooking grate of claim 2, wherein a distance from a center of the cooking grate to a first lateral side of the cooking grate is between 5 inches and 8 inches.

8. The cooking grate of claim 2, wherein the passageway comprises a plurality of passageways spaced apart along the first side rail, and wherein the utensil support structure comprises a plurality of support fingers.

9. The cooking grate of claim 8, further comprising:

a first set of the plurality of support fingers extending inward from the first side rail in the lateral direction; and a second set of the plurality of support fingers extending inward from the second side rail in the lateral direction.

10. The cooking grate of claim 9, wherein the first set and the second set of the plurality of support fingers are spaced apart from each other along the transverse direction, and wherein the plurality of passageways is formed between the first set of the plurality of support fingers.

11. A cooking appliance defining a vertical direction, a lateral direction, and a transverse direction, the cooking appliance comprising:

a cooktop comprising a gas burner; and a cooking grate mountable over the gas burner, the cooking grate comprising:

a peripheral frame rail defining a passageway extending from an inlet to an outlet, the outlet being positioned above the inlet along the vertical direction, and the outlet being positioned outward from the inlet along the lateral direction; and a utensil support structure extending inward from the peripheral frame rail for supporting a cooking utensil.

12. The cooking appliance of claim 11, wherein the peripheral frame comprises a first side rail and a second side rail each extending in the transverse direction, and wherein the passageway is defined through the first side rail.

13. The cooking grate of claim 12, wherein the passageway defines a rectangular cross-section in the lateral and transverse directions.

14. The cooking grate of claim 13, wherein the first side rail comprises a first lateral side wall and a second lateral side wall opposite the first lateral side wall, each of the first and second lateral side walls extending in the transverse direction, and wherein the passageway is defined between the first lateral side wall and the second lateral side wall.

15. The cooking grate of claim 14, wherein a lateral distance between the first lateral side wall and the second lateral side wall at the inlet of the passageway is greater than a lateral distance between the first lateral side wall and the second lateral side wall at the outlet of the passageway.

16. The cooking grate of claim 12, wherein the utensil support structure comprises a plurality of support fingers, the plurality of support fingers comprising:

a first set of the plurality of support fingers extending inward from the first side rail in the lateral direction; and a second set of the plurality of support fingers extending inward from the second side rail in the lateral direction.

17. The cooking grate of claim 16, wherein the first set and the second set of the plurality of support fingers are spaced apart from each other along the transverse direction, wherein the passageway comprises a plurality of passageways spaced apart along the first side rail, and wherein the plurality of passageways is formed between the first set of the plurality of support fingers.

18. The cooking grate of claim 12, further comprising a support peg extending from the first side rail in the vertical direction, wherein a resting position of the support peg on the cooktop is located at a top surface of the cooktop.

19. The cooking grate of claim 11, wherein a center of the cooking grate is positioned over a center of the gas burner, and wherein a distance from the center of the cooking grate to a first lateral side of the cooking grate is between 5 inches and 6 inches.

* * * * *